US005303910A

United States Patent [19]

McGill et al.

[11] Patent Number: 5,303,910

[45] Date of Patent: Apr. 19, 1994

[54] PICK-UP MEANS FOR USE WITH LIMP SHEET MATERIAL

[75] Inventors: Barry N. McGill, Maynardville; Moshe Shloush, Knoxville, both of Tenn.

[73] Assignee: Tice Engineering & Sales, Incorporated, Knoxville, Tenn.

[21] Appl. No.: 943,334

[22] Filed: Sep. 10, 1992

[51] Int. Cl.[5] ..... B65H 3/30

[52] U.S. Cl. ..... 271/21; 271/10; 271/272

[58] Field of Search ..... 271/10, 19, 21-23, 271/110, 111, 117, 118, 154, 155, 109, 114, 225, 902, 272

[56] References Cited

U.S. PATENT DOCUMENTS

| | | | |
|---|---|---|---|
| 793,009 | 6/1905 | Miller . | |
| 3,425,685 | 2/1969 | Liva | 271/21 |
| 3,608,890 | 9/1971 | Littlefield . | |
| 3,756,587 | 9/1973 | Lutts et al. . | |
| 3,856,294 | 12/1974 | Lutts et al. . | |
| 4,395,033 | 7/1983 | Janssen et al. . | |
| 4,482,144 | 11/1984 | Glassby | 271/21 |
| 4,578,013 | 3/1986 | Barillee et al. . | |
| 5,064,183 | 11/1991 | Nishigaki et al. | 271/10 |

FOREIGN PATENT DOCUMENTS

| | | | |
|---|---|---|---|
| 455813 | 1/1928 | Fed. Rep. of Germany | 271/23 |
| 2749908 | 5/1979 | Fed. Rep. of Germany . | |
| 2542 | 1/1980 | Japan | 271/19 |
| 198927 | 8/1990 | Japan | 271/21 |
| 1493575 | 7/1989 | U.S.S.R. | 271/19 |
| 1611822 | 12/1990 | U.S.S.R. | 271/21 |

*Primary Examiner*—D. Glenn Dayoan
*Assistant Examiner*—Boris Milef
*Attorney, Agent, or Firm*—Luedeka, Hodges, Neely & Graham

[57] ABSTRACT

A device for picking up a top layer of limp sheet material from a lay-up of sheet material includes a head assembly including a pair of rollers between which the top layer is retainably gripped and a double-acting cylinder for lifting the head assembly, with the top layer held thereby, to an elevated condition above the remainder of the lay-up. The device compensates for the reduction in the height of the lay-up as the layers are singularly picked up from the layer and includes a controller for automatically controlling the sequencing of operations of the device.

8 Claims, 5 Drawing Sheets

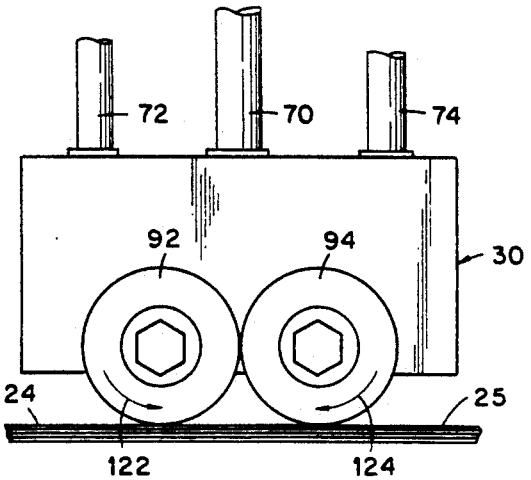
Fig. 8
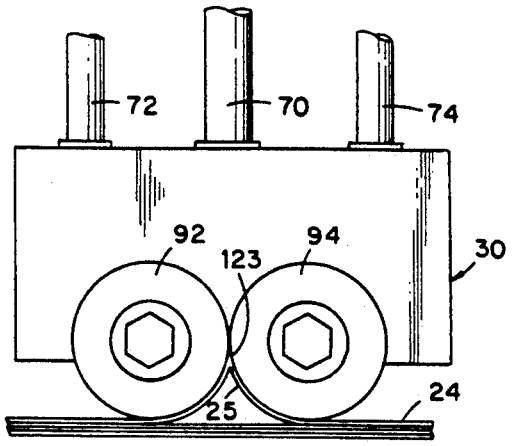
Fig. 9
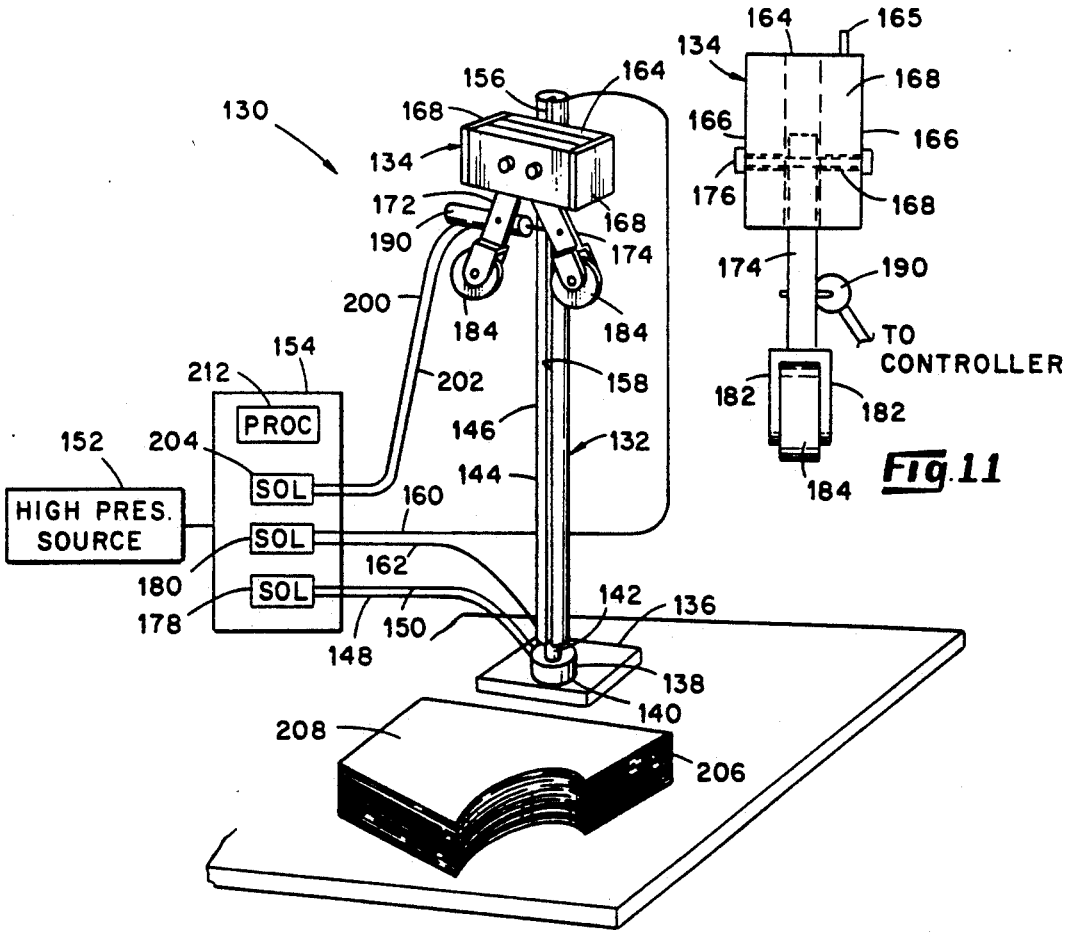
Fig. 10
Fig. 11

PICK-UP MEANS FOR USE WITH LIMP SHEET MATERIAL

BACKGROUND OF THE INVENTION

This invention relates generally to the transport of limp sheet material between two sites and relates, more particularly, to means for lifting single layers of limp sheet material from a lay-up of sheet material.

It is not uncommon in industrial applications that in order for individual pieces of limp sheet material to be worked upon by an operator, each piece must singularly be picked up manually by the operator from a stack of such pieces. It is known, however, that the repetitious movements required on the part of an operator to pick up such pieces may lead to physical problems such as carpal tunnel syndrome or pinch cramps. As a measure to prevent such physical problems and to save labor, it would be desirable to provide means which obviates the need for the manual pick up of individual pieces of limp sheet material from a stack thereof.

Accordingly, it is an object of the present invention to provide new and improved means for automatically picking up individual pieces of limp material from a lay-up of the material.

Another object of the present invention is to provide such means which, after picking-up each piece of material, transports the piece to an operator for handling.

Still another object of the present invention is to provide such means which compensates for the reduction in height of the lay-up as the pieces are singularly removed therefrom and which has an enhanced reliability for picking up pieces.

Yet another object of the present invention is to provide such means which is uncomplicated in construction and effective in operation.

SUMMARY OF THE INVENTION

This invention resides in a device for picking up a top layer of limp sheet material from a lay-up of sheet material.

The device includes means for gripping the top layer of a lay-up of limp sheet material and means for moving the gripping means toward the lay-up along a generally downwardly-directed path and away from the lay-up along a generally upwardly-directed path. The gripping means includes means for frictionally engaging two spaced regions of the top layer of the lay-up and means for moving the engaged regions relative to one another to form a fold between the engaged regions and so that the fold is retainably held by the engaging means. By moving the engaging means downwardly into engagement with the top layer of the lay-up and moving the engaged regions of the top layer relative to one another as aforesaid so that the top layer is held by the engaging means and subsequently moving the gripping means away from the lay-up, the top layer is lifted to an elevated position above the remainder of the lay-up.

The means for moving the gripping means downwardly toward the lay-up is adapted to exert an appreciable downwardly-directed force upon the lay-up through the engaging means while the engaged regions of the top layer are moved relative to one another to enhance the frictional gripping engagement between the engaging means and the top layer.

BRIEF DESCRIPTION OF THE DRAWINGS

FIG. 8 is a view similar to that of FIG. 6 illustrating schematically the head assembly of the FIG. 1 device when positioned in engagement with the underlying lay-up of sheet material.

FIG. 9 is a view similar to that of FIG. 8 illustrating the disposition of the top layer of the lay-up when gripped by the head assembly of the FIG. 1 device.

FIG. 10 is a perspective view of an alternative embodiment of a device for picking up limp sheet material and a schematic representation of the controls for the illustrated device.

FIG. 11 is a side elevational view of the head assembly of the FIG. 10 device as seen generally from the right in FIG. 10.

DETAILED DESCRIPTION OF THE ILLUSTRATED EMBODIMENTS

Figure 1:
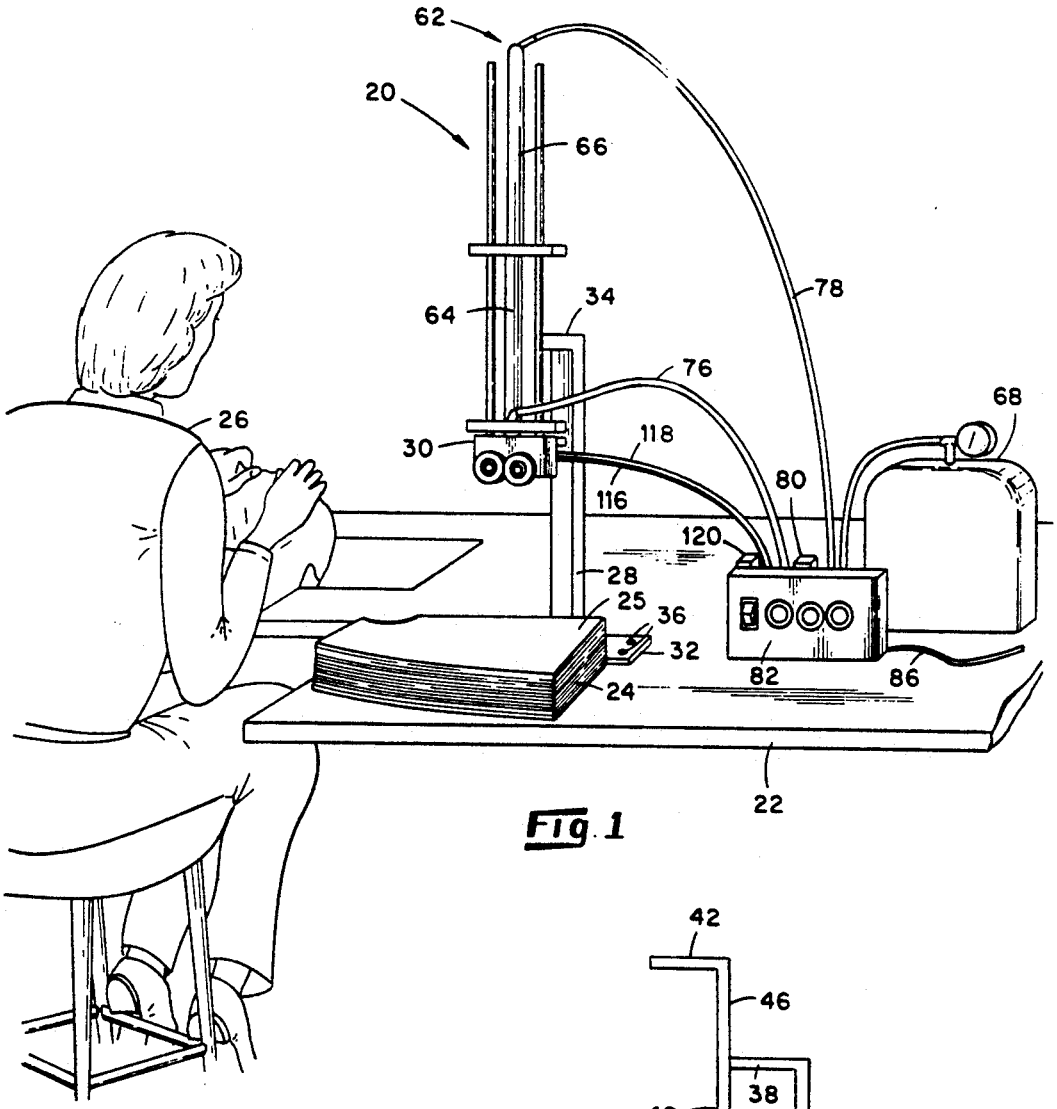
FIG. 1 is a perspective view illustrating an embodiment of the device being utilized in an environment of intended use.

Turning now to the drawings in greater detail and considering first FIG. 1, there is illustrated an embodiment, generally indicated 20, of a transport device shown in an exemplary environment of intended use. Such an environment includes a table 22 providing an upwardly-directed support surface and a stack or lay-up 24 of similarly-cut pieces of relatively limp material. Although the layers of the lay-up 24 may take any of a number of forms such as thin plastic sheets or fabric sheets comprised of natural or synthetic material, each layer of the depicted lay-up 24 is a fabric piece intended for use in the assembly of a garment item. As will be apparent herein, the device 20 grips each layer of the lay-up 24 one-at-a-time beginning with the top layer. A gripped layer is subsequently lifted by the device 20 to a station alongside an operator 26 where the gripped layer is manually pulled from the device 20 and worked upon by the operator 26.

Figure 2:
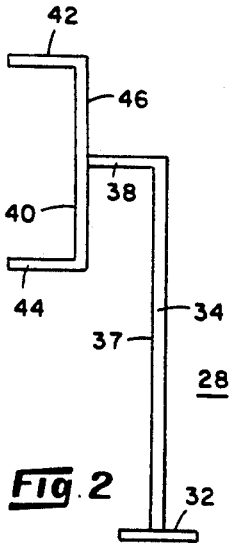
FIG. 2 is a side elevational view of the base of the FIG. 1 device as seen generally from the right in FIG. 1.
Figure 3:
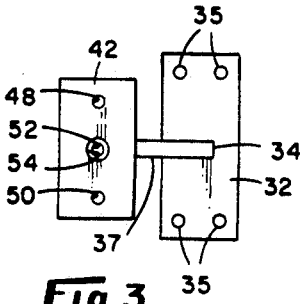
FIG. 3 is a plan view of the FIG. 2 base as seen generally from above in FIG. 2.

The device 20 includes a base 28 adapted to rest upon the table 22 and a head assembly 30 movably supported by the base 28 for movement generally toward and away from the lay-up 24. As best shown in FIGS. 2 and 3, the base 28 of the device 20 includes a pedestal section 32 which is substantially plate-like in form and in L-shaped section 34 attached to so as to extend upwardly from the pedestal section 32. The pedestal section 32 includes a plurality of holes 35 through which screws 36 (FIG. 1) can be inserted for securement of the pedestal section 32 to the table 22. The L-shaped section 34 includes two legs 37, 38 oriented at a right angle to one another. One leg 37 is fixedly secured, as with welds, atop the pedestal section 32 so as to extend substantially vertically therefrom, and the other leg 38 extends substantially forwardly of the device 20.

With reference still to FIGS. 2 and 3, the base 28 includes a bracket 40 having two opposite end plates 42, 44 joined by a bridge 46. The bracket 40 is attached to the leg 38 of the L-shaped section 34 so that the leg 38 is disposed substantially midway between the end plates 42, 44, and each of the plates 42, 44 is directed generally forwardly of the device 20. The plates 42, 44 include two sets 48, 50 of aligned apertures, and each plate 42 or 44 include a central aperture 52, 54 whose purpose will become apparent herein.

Figure 4:
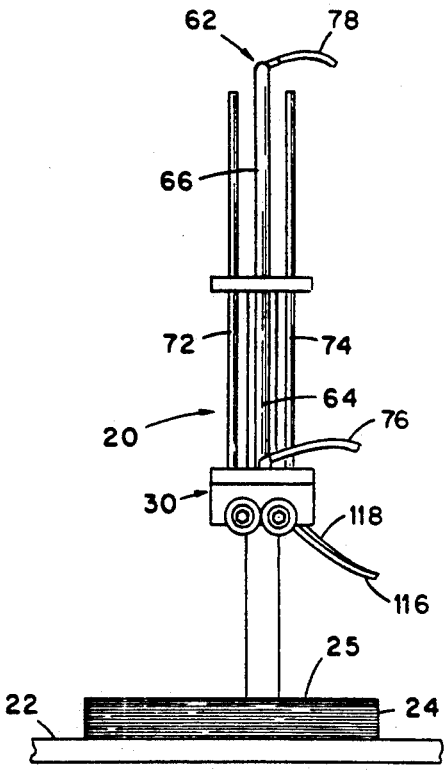
FIG. 4 is a fragmentary elevational view of the FIG. 1 device as seen generally from the front in FIG. 1 and illustrating the head assembly of the device when positioned in a raised condition.
Figure 5:
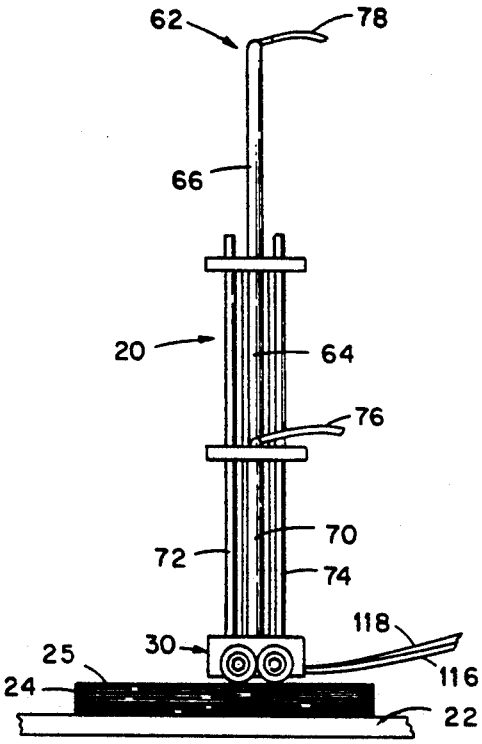
FIG. 5 is a view similar to that of FIG. 4 illustrating the head assembly of the device when positioned in a lowered condition.

With reference again to FIG. 1, the device 20 includes means, generally indicated 62, for moving the head assembly 30 between a raised position above the lay-up 24 as shown in FIG. 4 and a lowered position upon the lay-up 24 as shown in FIG. 5 so that the head assembly 30 moves generally toward and away from the lay-up 24 as it is moved between the FIG. 4 and FIG. 5 positions. In the depicted device 20, the moving means 62 includes an air-actuated cylinder assembly 64 having an elongated housing 66 and a movable piston (not shown) slidably mounted within the housing 66 for movement therealong. The cylinder assembly 64 is double-acting in that the introduction of pressurized air from a pressurized air source 68 (FIG. 1) such as a tank containing compressed air into one end of the housing 66, i.e., the upper end as viewed in FIGS. 4 and 5, urges the piston downwardly while the introduction of pressurized air into the opposite end of the housing 66, i.e., the lower end as viewed in FIGS. 4 and 5, urges the piston upwardly. A ram 70 (best shown in FIG. 5) is joined at one end to the piston and joined at the other end to the head assembly 30 for moving the head assembly 30 between the FIG. 4 and FIG. 5 positions as the piston is moved upwardly or downwardly along the cylinder assembly housing 66.

In this connection, the cylinder assembly 64 includes a pair of internal chambers for urging the ram 70 under the influence of air pressure, toward either of its raised FIG. 4 or lowered FIG. 5 positions. With reference again to FIG. 1, air from the pressurized air source 68 is routed to the internal chambers of the cylinder assembly 64 by way of air hoses 76, 78, and an electrically-operated solenoid valve 80 mounted within a controller 82 is appropriately connected to the hoses 76, 78 for control of the actuation of the cylinder assembly 64. In the depicted device 20, the solenoid 80 is connected to the hoses 76, 78 so that until the valve 80 is actuated, a first of the internal chambers of the assembly 64 remains pressurized and so that the ram 70 is maintained in its raised FIG. 4 position. Upon actuation of the valve 80, the air in the first internal chamber of the assembly 64 is vented and the second internal chamber is pressurized so that the ram 70 is moved downwardly from its raised FIG. 4 position toward its FIG. 5 lowered position upon the lay-up 24. Upon de-actuation of the valve 80, the second chamber is vented and the first chamber is re-pressurized to return the ram 70 from its lowered FIG. 5 position to its raised FIG. 4 position. Power for the solenoid valve 80 is supplied from an electric power source through a cord 86.

With reference still to FIGS. 4–7, the head assembly 30 includes a body in the form of an L-shaped member 56 having an upper plate portion 58 and a front plate portion 60 joined at a right angle to one another. A pair of parallel guide rods 72, 74 are attached at one end to the L-shaped member 56 of the head 30 and are loosely received by the sets of aligned apertures 48, 50 in the base plates 42, 44 for sliding movement therealong. More specifically, one guide rod 72 extends through the apertures of one aperture set 48 and the other guide rod 74 extends through the apertures of the other aperture set 50. As the head assembly 30 is moved toward and away from the lay-up 24 between the raised position of FIG. 4 and the lowered position of FIG. 5, the guide rods 72, 74 slidably move along the aligned sets 48, 50 of apertures to stabilize and guide the movement of the head assembly 30 toward and away from the lay-up 24.

Figure 6:
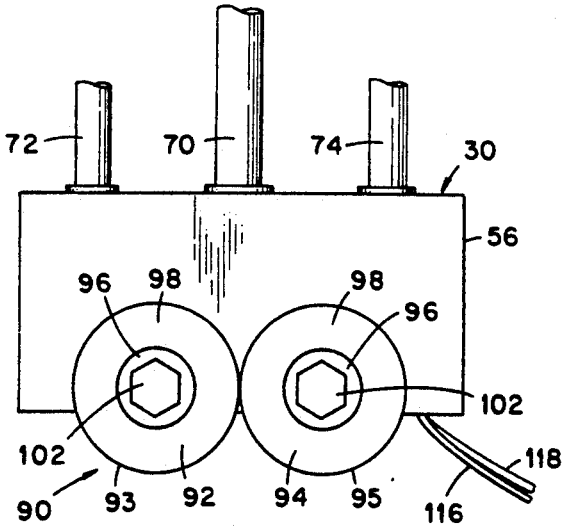
FIG. 6 is a fragmentary elevational view of the head assembly of the FIG. 1 device as seen generally from the front in FIG. 1.
Figure 7:
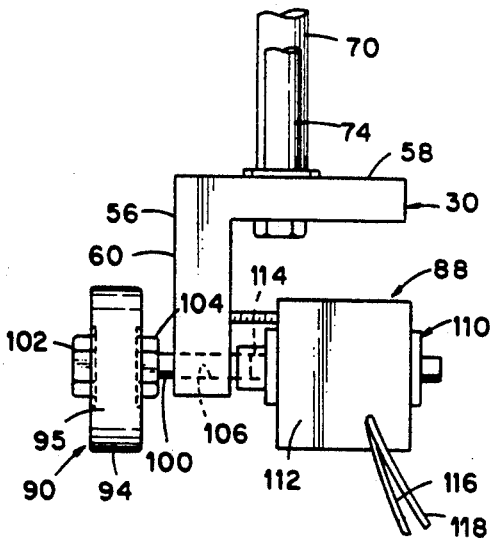
FIG. 7 is a side elevational view of the head assembly of the FIG. 1 device as seen generally from the right in FIG. 6.

As best shown in FIGS. 6 and 7, the head assembly 30 also includes means, generally indicated 90, for frictionally engaging two spaced regions on the upper surf ace of the top layer of the lay-up 24 and means, generally indicated 88, for moving the engaged regions of the top layer toward one another to form a fold therebetween which is nipped by the frictionally engaging means 90. In the depicted device 20, the engaging means 90 includes a pair of rollers 92, 94 mounted upon the L-shaped member 56 for rotation relative thereto about parallel axes. Each roller 92 or 94 of the depicted device 20 is about 1.5 inches in diameter and includes a central section 96 and an outer section 98 extending about the central section 96. The central section 96 is fixed upon a shank 100 having a head 102 and a nut 104 threaded upon the shank 100 so that the central section 96 is tightly held between the head 102 and the nut 104 and so that rotation of the shank 100 effects rotation of the corresponding roller 92 or 94. As best shown in FIG. 7, each shank 100 extends through a bore 106 provided within the front plate 60 to accommodate rotation of the shank 100 about an axis of rotation corresponding generally with the longitudinal axis of the shank 100. The shank 100 associated with the roller 92 is secured within its corresponding bore 106 with a nut secured about the end of the shank 100 opposite the head 102.

The outer section 98 of each roller 92 or 94 provides the roller with a substantially cylindrical peripheral surface 93 or 95, and each peripheral surface 93 or 95 is defined by a relatively high-friction material. Although the material of the outer sections 98 may take any of a number of suitable materials, the outer sections 98 of the depicted rollers 92, 94 are comprised of a relatively soft rubber of a type commonly used for advancing paper in paper-feeding apparatus. In the head assembly 30, the rollers 92, 94 are arranged in a side-by-side relationship so that the peripheral surfaces 93, 95 thereof are in engagement with one another as shown in FIG. 6. With the peripheral surfaces 93, 95 in engagement with one another in this manner, the rotation of one roller 92 or 94 in one rotational direction effects the rotation of the other roller 94 or 92 in the opposite rotational direction.

With reference still to FIG. 7, the moving means 88 for moving the frictionally-engaged regions of the top layer toward one another includes an air-powered rotary actuator 110 having a housing 112 which is fixedly secured to the front plate 60 on the side thereof opposite the rollers 92 and 94 and a shaft 114 which is fixedly secured in registry with the shank 100 associated with the roller 94 to effect rotation of both of the rollers 92, 94 upon actuation of the actuator 110. The actuator 110 is a double-acting type of device having a pair of internal chambers for urging the shaft 114, under the influence of air pressure, in one rotational direction or the other rotational direction through a predetermined number of angular degrees. Air from the pressurized air source 68 (FIG. 1) is routed to the internal chambers of the actuator housing 112 by way of air hoses 116, 118 routed to the controller 82. An electrically-operated solenoid valve 120 is mounted within the controller 82 and appropriately connected to the hoses 116, 118 for controlling the actuation of the actuator 110.

Until actuation of the solenoid valve 120, a first of the internal chambers of the actuator 110 remains pressurized so that the shaft 114 is maintained in a first position at which the roller 94 is oriented in a first, or home, rotational position. Upon actuation of the valve 120, the air in the first internal chamber of the actuator 110 is vented and the second of the internal chambers is pressurized so that the shaft 114 is suddenly rotated from the first rotational position through a preselected number of angular degrees to a second rotational position. Upon subsequent de-actuation of the valve 120, the second chamber is vented and the first chamber is re-pressurized to return the shaft 114 from the second rotational position to the first rotational position. An example of an actuator suitable for use as the rotary actuator 110 is available from SMC Corporation of Japan under the designation Series CRB.

In preparation of the device 20 for use and with reference again to FIGS. 1 and 4, the device 20 is situated adjacent a work station at which the operator 26 is positioned and the lay-up 24 of limp sheet material is positioned directly beneath the head assembly 30. Upon initiation of one cycle of the device 20, the solenoid valve 80 is actuated so that the air cylinder assembly 64 forces the head assembly 30 downwardly upon the lay-up 24 so that the peripheral surfaces of the rollers 92, 94 engage two spaced regions of the top layer, indicated 25 in FIG. 8. The rotary actuator 110 is then actuated by means of the valve 120 so that each roller 92 or 94 is rotated from its home position in the direction indicated by the corresponding arrow 122 or 124 (FIG. 8) through a preselected number of degrees, i.e., about 90 degrees, to a second rotational position. As the rollers 92, 94 are rotated in the aforedescribed manner, the engaged regions of the layer 25 are pulled toward one another to form a fold, indicated 123 in FIG. 9, and so that the resultant fold 123 is nipped and retainably held between the rollers 92, 94 as illustrated in FIG. 9.

The solenoid valve 80 associated with the cylinder assembly 64 is subsequently de-actuated so that the head assembly 30 and the layer 25 held thereby are raised to the initial, raised position of the head assembly 30 illustrated in FIG. 1. The operator 26 then removes the layer 25 from between the rollers 92, 94 by simply grasping and pulling the layer 25 downwardly from the rollers 92, 94. Upon the passage of a prescribed period of time, e.g., a period sufficient to permit the operator 26 to remove the layer 25 from the rollers 92, 94, the actuator 110 is de-actuated to return the rollers 92, 94 to the original, or home, position thereby completing one cycle of operation of the device 20. The head assembly 30 is subsequently lowered and raised with respect to the lay-up 24 and the rollers 92, 94 are rotated between the first, or home, rotational position and the second rotational position in the aforedescribed sequence to lift each layer of the lay-up 24 one-at-at-time to a desired level at which the operator 26 can easily grasp the gripped layer. The sequencing of the actuation and de-actuation of the solenoid valves 80, 120 for control of the operation of the device 20 is controlled by an appropriate timing circuit, e.g. a programmable microprocessor, associated with the controller 82 and suitably wired to the valves 80, 120.

An advantage provided by the device 20 relates to the Movement of the rollers 92, 94 downwardly into engagement with the lay-up 24, even though the height of the lay-up 24 is constantly reduced as the layers are singularly removed from the lay-up 24. Because the cylinder assembly 64 is air-actuated, the head assembly 30 is urged downwardly upon the lay-up 24 until the downwardly-directed pressure of the head assembly 30 upon the lay-up 24 equals the upwardly-directed pressure of the lay-up 24 upon the head assembly 30. Therefore, even though the lay-up 24 is reduced as the layers are singularly removed, the head assembly 30 is urged downward into engagement with the lay-up 24 by the air cylinder assembly 64 during each cycle of operation of the device 20. Furthermore, the downwardly-directed pressure exerted by the cylinder assembly 64 is maintained by the cylinder assembly 64 while the engaged regions of the top layer 25 are moved to the position between the rollers 92, 94 at which the layer 25 is held by the head assembly 30 to increase the likelihood that a layer is picked up between the rollers 92, 94 during each cycle of operation of the head assembly 30.

With reference to FIG. 10, there is schematically illustrated another embodiment, generally indicated 130, of a device within which features of the present invention are embodied. The device 130 includes a base 132 and a head assembly 134 supported by the base 132 for movement upwardly and downwardly with respect thereto and in an arcuate path, as described herein, between two angular positions. In the depicted device 130, the base 132 includes a pedestal 136 and a rotary actuator 138 having a housing 140 and a shaft 142. The actuator housing 140 is mounted upon the pedestal 136 in a stationary condition therewith and so that the shaft 142 is oriented substantially vertically.

The base 132 also includes an air cylinder assembly 144 having an elongated housing 146 oriented substantially vertically and mounted in a relatively stationary condition upon the shaft 142 of the actuator 138 so that as the actuator shaft 142 is rotated about a vertical axis, the cylinder assembly 144 is rotated by the shaft 142 by a corresponding amount. The rotary actuator 138 is a double-acting air cylinder similar in structure and operation to the actuator 110 of the device 20 of FIGS. 1–8. Air is delivered to the actuator 138 by means of a pair of hoses 148, 150 joined between the actuator 138 and a source 152 of pressurized air. A controller 154 including a solenoid 178 is suitably joined to the hoses 148, 150 for controlling the actuation of the actuator 138. As will be apparent, the actuator 138 of the depicted device 130 is adapted to rotate the cylinder assembly 144 about a vertical axis between two angular positions and through about 90 degrees of movement between the two angular positions.

The air cylinder assembly 144 is similar in structure to that of the cylinder assembly 64 of the device 20 of FIGS. 1–9 in that a piston is slidably positioned within the cylinder housing 146 for movement therealong between two internal variable-volume chambers. Connected to opposite ends of the piston through the ends of the housing 146 is a cord 156 having a portion 158 positioned along the exterior of the housing 146. As will be apparent herein, as the piston of the cylinder assembly 144 is moved upwardly and downwardly along the interior of the housing 146, the cord portion 158 is moved downwardly and upwardly along the exterior of the housing 146. The head assembly 134 is fixedly secured to the cord portion 158 so that movement of the cord portion 158 downwardly and upwardly along the housing 146 moves the head assembly 134 downwardly and upwardly along the housing 146 by a corresponding amount. An example of a cylinder assembly suitable for use as the cylinder assembly 144 is available under the trade designation Standard Cable Cylinder (e.g. Model No. 5100-3/4) from Tol-O-Matic, Inc. of Minneapolis, Minn.

Air is supplied to the cylinder assembly 144 by a pair of hoses 160, 162 joined between the cylinder assembly 144 and the pressurized air source 152 by way of the controller 154 having a solenoid 180 associated with the hoses 160, 162. By actuating and de-actuating the solenoid 180 so that the two internal chambers of the housing 146 are pressurized and vented in an alternating fashion, the cord portion 156 and the head 134 attached thereto are moved upwardly or downwardly along the exterior of the housing 140.

Figure 12:
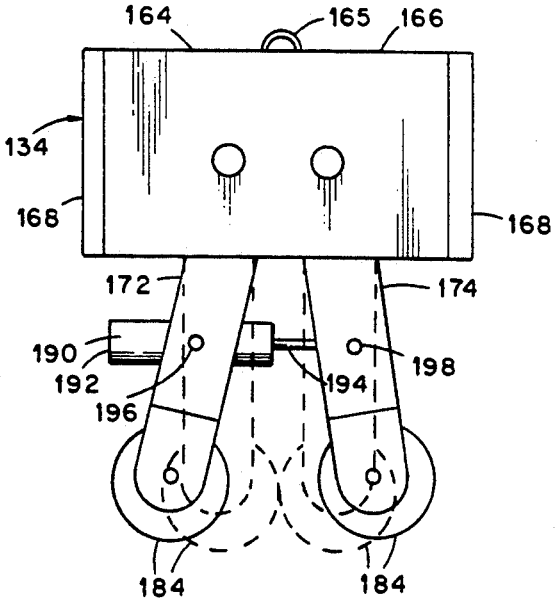
FIG. 12 is a front elevational view of the FIG. 11 head assembly as seen from the left in FIG. 11.

As best shown in FIGS. 11 and 12, the head assembly 134 includes a body 164 comprised of a pair of parallel plates 166 maintained in a stationary and spaced relationship with one another by means of a pair of end plates 168 secured across each of the ends of the plates 166. One plate 166 of the head assembly 134 is provided with an eyelet 165, and the cord portion 156 is attached to the eyelet 165 to ensure movement of the head assembly 134 with the cord portion 156 along the exterior of the hosing 146. The plates 166 are provided with two sets of aligned openings 168 formed therethrough for a purpose which will be apparent herein.

The head assembly 134 also includes a pair of arm members 172, 174 each having one end which is positioned between and pivotally attached to the plates 166. To this end, the portion of each arm member 172 or 174 positioned between the plates 166 is provided with a through-hole which is aligned with one of the sets of aligned openings 168, and a pin 176 is positioned and secured through each set of aligned openings 168 and through-hole to effect the pivotal attachment of the corresponding arm member 172 or 174. The opposite, or lower end as viewed in FIGS. 11 and 12, of each arm member 172 or 174 is bifurcated so as to provide two downwardly-extending forks 182, and a roller 184 is positioned and secured between each pair of forks 182. An axle 186 extends through aligned openings provided in the forks 182 and the roller 184 and is tightened against the forks 182 so that the forks 182 pressingly engage the corresponding roller 184 or opposite sides thereof so that the roller 184 is prevented from rotating relative to its corresponding arm member 172 or 174. The outer portion of each roller 184 is comprised of a material, e.g., soft rubber, which provides its periphery with a high-friction surface.

The head assembly 134 also includes means, generally indicated 188, for moving the rollers 184 toward and away from one another. In this connection, the arm members 172, 174 are pivotally suspended from the body 164 of the head assembly 134 so that are roller 184 is spaced a distance from its corresponding pin 176 which is equal to the distance which the other roller 184 is spaced from its corresponding pin 176, and the moving means 188 includes a double-acting air cylinder assembly 190 joined between the arm members 172, 174. As best shown in FIG. 12, the cylinder assembly 190 includes a cylinder 192 and a ram 194 mounted within the cylinder 192 for movement relative thereto between extended and retracted positions. The cylinder 192 is secured, by means of a pin 196, to the arm member 172, and the ram 194 is secured, by means of a pin 198, to the arm member 174. Air is conducted to the cylinder assembly 190 by a pair of hoses 200, 202 (FIG. 10) extending from the cylinder assembly 190 and joined in flow communication with air from the pressurized air source 152 through the controller 154. A solenoid 204 is mounted within the controller 154 and controllably joined to the hoses 200, 202 so that actuation of the cylinder assembly 190 moves the ram 194 from an extended position of which the rollers 184 are spaced from one another, as illustrated in solid lines in FIG. 12, to a retracted position at which the rollers 184 engage one another as illustrated in phantom in FIG. 12. Conversely, de-actuation of the cylinder assembly 190 moves the ram 194 from its retracted position to its extended position so that the rollers 184 are moved from the engaged, FIG. 12 phantom-line position to the spaced, FIG. 12 solid-line position.

Figure 13:
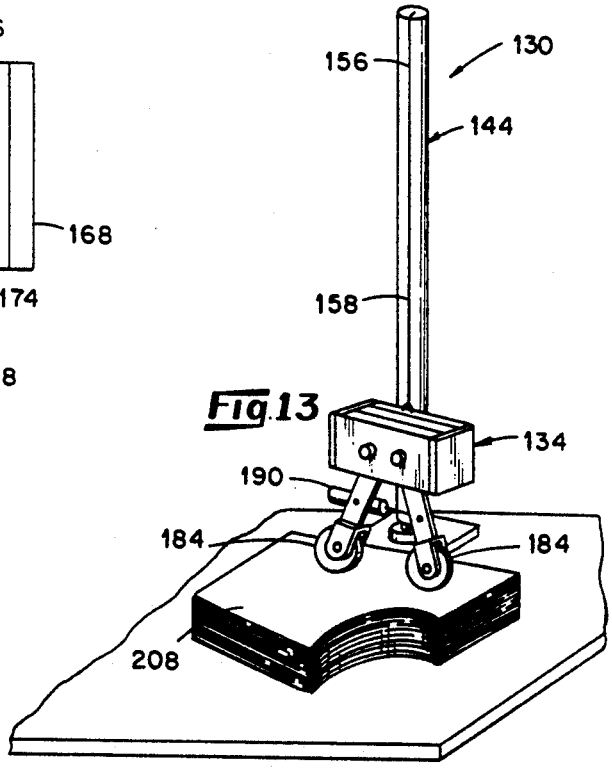
FIGS. 13–16 are perspective views illustrating sequential operations of the FIG. 10 device.

With reference to FIGS. 10 and 13–16, there are shown various positions of the head assembly 134 during sequential steps of the operation of the device 130. At the beginning of a cycle of operation with the device 130, the head assembly 134 is positioned in an elevated position above a lay-up, indicated 206, of limp sheet material and the rollers 184 are positioned in spaced relationship. Upon initiation of the operation of the device 130, the solenoid 180 is actuated so that the head assembly 134 is lowered by the cylinder assembly 144 to the position as shown in FIG. 13 at which the peripheral surface of the rollers 184 are positioned in engagement with the top layer, indicated 208, of the lay-up 206.

Figure 14:
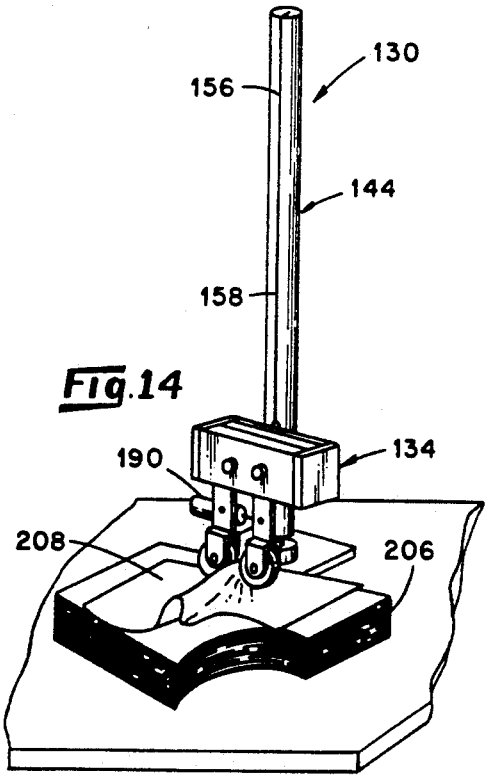

The solenoid 204 is subsequently actuated so that the cylinder assembly 190 moves the rollers 184 toward and into engagement with one another. As the rollers 184 are moved toward one another, the air cylinder assembly 144 maintains a downwardly-directed pressure upon the head assembly 134 so that the rollers 184 maintain a frictional gripping relationship with the top layer 208 and so that the frictionally-engaged regions of the top layer 208 are pulled toward one another to form a fold therebetween and so that the resulting fold is nipped so as to be retainably held between the rollers 184 as shown in FIG. 14. With the top layer 208 held between the rollers 184, the cylinder assembly 144 is de-actuated so that the head assembly 134 is raised to the elevated position as shown in FIG. 15.

Figure 15:
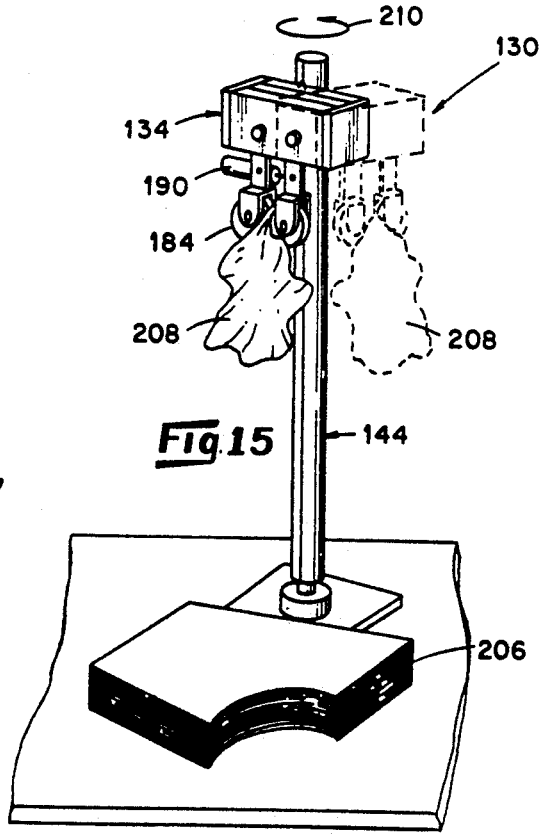
Figure 16:
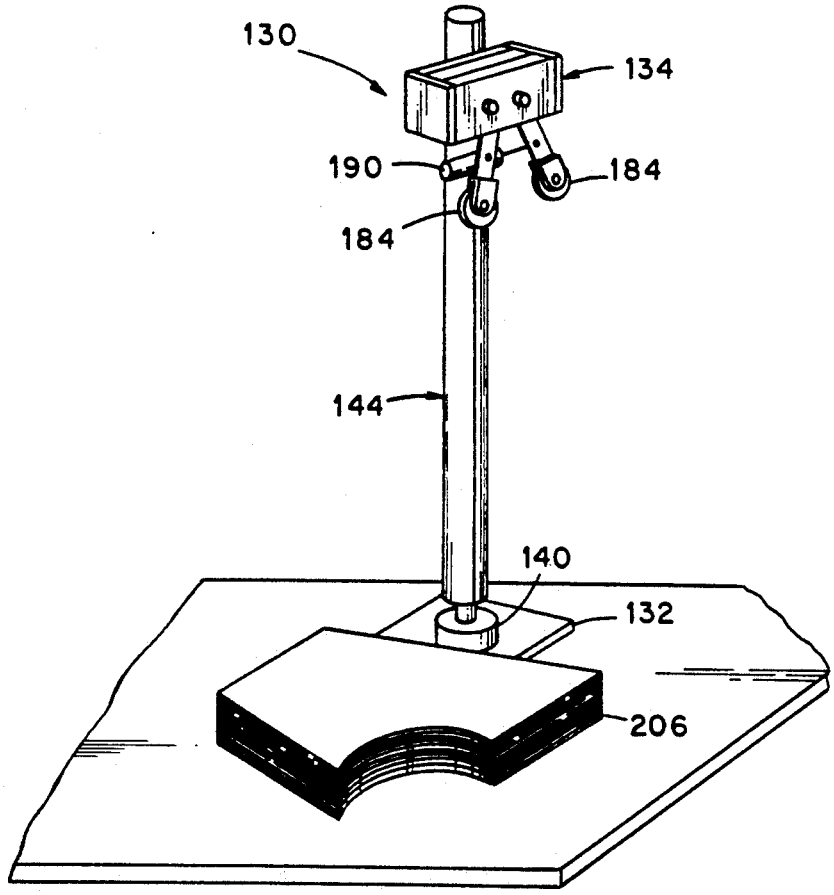
Figure 17:
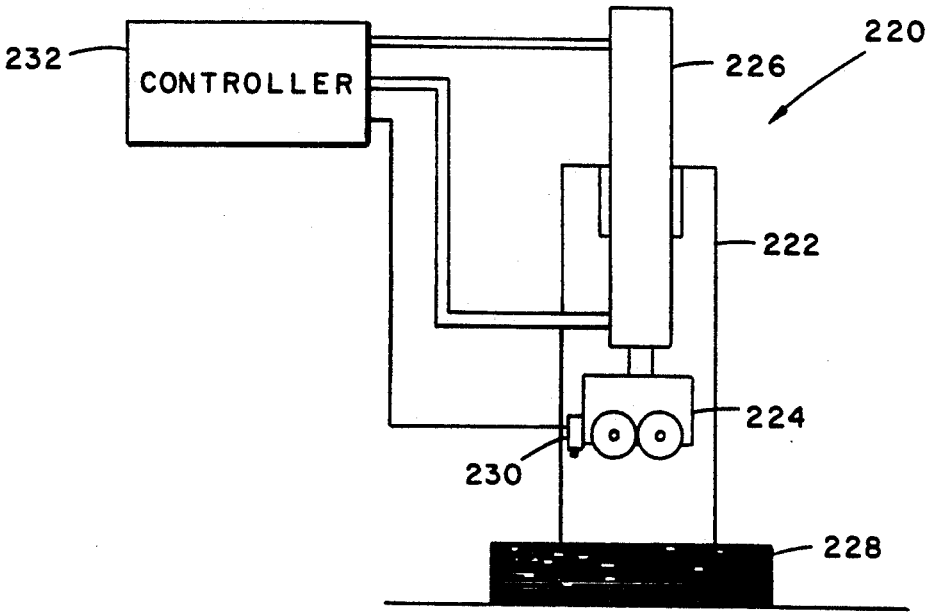
FIG. 17 is a schematic view of still another embodiment of a device for picking up limp sheet material.

With the top layer 208 gripped by the head assembly 134 in the aforedescribed manner, the solenoid 178 is actuated to actuate the rotary actuator 138 so that the carriage assembly 144 is rotated by a predetermined number of degrees, i.e., 90 degrees in the direction of the arrow 210 of FIG. 15 so that the head assembly 134 is moved from the position illustrated in solid lines in FIG. 15 to the position illustrated in phantom in FIG. 15. With the head assembly 134 moved in this manner, the layer 208 held between the rollers 184 is moved to one side of the device 130 at which the layer 204 is better accessible to an operator stationed to the one side of the device 130. The layer 208 is then removed from between the rollers 184 as the operator grasps and pulls the layer 208 downwardly from the rollers 184. The cylinder assembly 190 is subsequently de-actuated to return the rollers 184 to the spaced condition as illustrated in FIG. 16, and the actuated 140 is de-actuated to return the head assembly 134 to the original, home position of FIG. 10. The sequencing of the various components of the device 130, as well as the time involved at each step of the operation, is controlled by a microprocessor 212 mounted within the controller 154.

It will be understood that numerous modifications and substitutions can be had to the aforedescribed embodiment without departing from the spirit of the invention. For example, although the head assembly of each of the aforedescribed devices 20 and 130 have been shown and described as movable along vertical and/or rotary paths, the head assembly of a device in accordance with the broader aspects of this invention could be mounted for movement along paths of alternative directions. For example, for movement of a head assembly along a horizontal path, the head assembly may be supported for movement along a horizontally-disposed guideway.

Furthermore, although the aforedescribed embodiments 20 and 130 have been shown and described as utilizing an air-actuated cylinder for moving the corresponding head assembly downwardly into engagement with a lay-up of limp sheet material, a device in accordance with the broader aspects of this invention may utilize alternative means for urging the head assembly into engagement with the lay-up. For example, there is illustrated in FIG. 10 an embodiment, indicated 220, of the device including a base 222 and a head assembly 224 which is movable along a vertical path relative to the base 222 by means of a hydraulic cylinder assembly 226. A lay-up, indicated 228, of limp sheet material is disposed generally below the head assembly 224. In the depicted device 220, the downwardly-directed pressure of the head assembly 224 upon the lay-up 228 is controlled by means of a pressure sensor 230 mounted to one side of the head assembly 224 and an associated controller 232 associated with the device 220. As the head assembly 224 is moved downwardly upon the lay-up 228 by the cylinder assembly 226, the pressure sensor 230 monitors the pressure exerted upon the lay-up 228 by the head assembly 224 and ceases, by way of the controller 232, the continued downward movement of the head assembly 224 upon the lay-up 228 when the pressure sensed by the sensor 230 exceeds a predetermined limit. Therefore, the pressure sensor 230 acts as a safety switch which prevents the lay-up (comprised, for example, of delicate material) from being harmed by excessive forces exerted downwardly upon the lay-up by the cylinder 226 and the head assembly 224.

Accordingly, the aforedescribed embodiments are intended for the purpose of illustration and not as limitation.

We claim:

1. A device for picking up a top layer from a lay-up of limp sheet material comprising:

means for gripping the top layer of a lay-up of limp sheet material;

the gripping means further comprising two cylindrical rollers in contact at their periphery, the periphery of each roller further comprising a high-friction material the axes of rotation of said rollers being fixed relative to each other;

means for moving the gripping means toward and away from the lay-up of limp sheet material;

a double-acting rotary actuator adapted to first rotate the rollers in opposite rotational directions relative to one another through a predetermined number of angular degrees so as to fold and nip the top layer of the lay-up between the rollers and then to rotate the rollers in the reverse rotational directions through the predetermined number of angular degrees so as to release the top layer so nipped;

means for mounting the gripping means, moving means, and double-acting rotary actuator together as a single unit.

2. The device as defined in claim 1 wherein the means for moving the gripping means includes a double-acting cylinder having an elongated housing and a piston mounted within the housing for sliding movement along the length thereof and connected to the gripping means so that upon movement of the piston in one direction along the length of the housing moves the gripping means toward the lay-up and upon movement of the piston in the opposite direction along the length of the housing moves the gripping means away from the lay-up.

3. The device as defined in claim 2 wherein the double-acting cylinder is an air cylinder.

4. The device as defined in claim 2 wherein the double-acting cylinder is a hydraulic cylinder.

5. The device as defined in claim 1 further comprising:

means for sensing the pressure exerted upon the lay-up by the means for gripping, and generating a signal proportional to that pressure;

means for comparing the signal generated by the sensing means to a predetermined amount, and limiting the pressure exerted upon the lay-up by the means for gripping to that predetermined amount.

6. The device as defined in claim 1 wherein the high-friction material at the periphery of each roller is soft rubber.

7. The device as defined in claim 1 wherein the double-acting rotary actuator is connected in driving relationship with one of the rollers, and the peripheries of the rollers are positioned in engagement with one another so that rotation of one roller in one rotational direction effects the rotation of the other roller in the opposite rotational direction.

8. The device as defined in claim 1 further comprising controller means for controlling the sequencing of the operations of the device so that during one cycle of the device, the gripping means are automatically moved downwardly to the lay-up where the gripping means fold and nip the top layer, the top layer is automatically lifted to an elevated position above the remainder of the lay-up, and the gripping means automatically release the top layer.

* * * * *